United States Patent [19]

Lawson et al.

[11] Patent Number: 4,830,028

[45] Date of Patent: May 16, 1989

[54] SALTS PROVIDED FROM NICOTINE AND ORGANIC ACID AS CIGARETTE ADDITIVES

[75] Inventors: Jerry W. Lawson, Clemmons; Bruce R. Bullings; Thomas A. Perfetti, both of Winston-Salem, all of N.C.

[73] Assignee: R. J. Reynolds Tobacco Company, Winston-Salem, N.C.

[21] Appl. No.: 12,922

[22] Filed: Feb. 10, 1987

[51] Int. Cl.[4] ..... A24B 15/28; A24B 15/30; A24B 15/42; C07D 239/70

[52] U.S. Cl. ..... 131/352; 131/310; 514/343; 546/281; 546/282

[58] Field of Search ..... 546/281, 282, 25; 514/343, 88; 131/336, 352, 310, 3

[56] References Cited

U.S. PATENT DOCUMENTS

| | | | |
|---|---|---|---|
| 2,152,236 | 3/1939 | Batchelder | 167/ |
| 2,207,694 | 7/1940 | Baier | 260/ |
| 2,766,145 | 10/1956 | Jones | 131/ |
| 2,914,072 | 11/1959 | Tyrer et al. . | |
| 3,095,882 | 7/1963 | Hind et al. | 131/ |
| 3,109,436 | 11/1963 | Bavley et al. | 131/ |
| 3,136,319 | 6/1964 | Jarboe et al. | 131/ |
| 3,280,823 | 3/1966 | Bavley et al. | 131/ |
| 3,319,630 | 5/1967 | Orrmins . | |
| 3,422,819 | 1/1969 | Jones et al. . | |
| 3,584,630 | 6/1971 | Inskeep | 131/ |
| 3,861,400 | 1/1975 | Perkins et al. . | |
| 3,878,850 | 4/1975 | Gibson et al. | 131/ |
| 3,924,642 | 12/1975 | Eicher et al. . | |
| 3,924,644 | 12/1975 | Anderson et al. . | |
| 4,125,118 | 11/1978 | Rudner . | |
| 4,236,532 | 12/1980 | Schweizer et al. | 131/ |
| 4,256,126 | 3/1981 | Seligman et al. . | |
| 4,286,604 | 9/1981 | Ehretsmann et al. | 131/ |
| 4,300,576 | 11/1981 | van der Loo et al. . | |
| 4,481,960 | 11/1984 | Brooks . | |
| 4,506,682 | 3/1985 | Muller . | |
| 4,595,024 | 6/1986 | Greene et al. | 131/ |
| 4,676,259 | 6/1987 | Ellis et al. . | |
| 4,714,082 | 12/1987 | Banerjee et al. . | |
| 4,715,389 | 12/1987 | Lynm et al. . | |

FOREIGN PATENT DOCUMENTS

| | | |
|---|---|---|
| 103969 | 3/1984 | European Pat. Off. . |
| 3312159 | 4/1983 | Fed. Rep. of Germany . |
| 988608 | 8/1951 | France . |
| 124711 | 2/1983 | Japan . |
| 446368 | 4/1936 | United Kingdom . |
| 1111007 | 4/1968 | United Kingdom . |
| 1495941 | 2/1974 | United Kingdom . |
| 2094611 | 9/1982 | United Kingdom . |
| 2185175 | 7/1987 | United Kingdom . |

OTHER PUBLICATIONS

Perfetti, *Beitrage Tabakforschung Int'l*, vol. 12, No. 2, pp. 43–54 (1983).

Gabel et al., *Ukr. Khim. Zbur.*, 5, pp. 167–184 (1930).

Leffringwell et al., *Tobacco Flavoring for Smoking Products*, pp. 11–15 (1972).

Sensabaugh et al., *Tobacco Science*, vol. II, pp. 25–30 (1967).

Houseman, *Beitr. Takabforsch.*, vol. 7, pp. 142–147 (1973).

Armitage et al., *Quarterly Journal of Experimental Physiology*, vol. 59, p. 55 (1974).

Jenkins et al., *Int'l Journal of Applied Radiation and Isotopes*, vol. 27, pp. 323–324 (1976).

Abdallah, Sensory Testing of Cigarette Smoke, Panel Selection, Training and Use; North Carolina State Univ. Ph. D. Thesis (1974).

Wynder et al., *Tobacco and Tobacco Smoke*, p. 428 (1967).

Dickens, *On Cancer and Hormones*, pp. 107–120 (1962).

Quin and Hobbs, *Anal. Chem.*, vol. 30, pp. 1400–1405 (1958).

Dickens and Black, *Rept. Brit. Empire Cancer Campaign*, vol. 42 (2), pp. 157–158 (1964).

Court et al., *J. Chroma. Sci.*, vol. 16, pp. 314–317 (1978).

Sakuma et al., *Beitr. Tabak.*, vol. 12, pp. 63–71 (1983).

Leonard, *Industrial and Engineering Chemistry*, vol. 48, 1331–1341 (1956).

*Primary Examiner*—V. Millin

[57] ABSTRACT

Cigarettes having incorporated therein a salt such as nicotine levulinate exhibit low FTC "tar" to nicotine ratios while (i) having a smooth, palatable, flavorful taste, and (ii) providing smoking satisfaction to the user. The cigarettes do not exhibit a harsh or irritating character; and do not exhibit a non-tobacco or off-taste.

44 Claims, 1 Drawing Sheet

SALTS PROVIDED FROM NICOTINE AND ORGANIC ACID AS CIGARETTE ADDITIVES

BACKGROUND OF THE INVENTION

The present invention relates to smoking articles such as cigarettes, and in particular to those smoking articles having incorporated therein an additive comprising nicotine and an organic acid.

Popular smoking articles such as cigarettes have a substantially cylindrical rod shaped structure and include a charge of smokable material such as particulates of tobacco (i.e., cut filler) surrounded by a wrapper such as paper thereby forming a tobacco rod. It has become desirable to manufacture cigarettes having cylindrical filters aligned in an end-to-end relationship with the tobacco rod. Typically, filters are manufactured from fibrous materials such as cellulose acetate and are attached to the tobacco rod using a circumscribing tipping material.

The so called "full flavor" cigarettes are popular smoking articles which delivers a desirable tobacco taste, flavor and satisfaction to the smoker. Typically, the "full flavor" cigarettes deliver about 14 mg or more of FTC "tar" per cigarette. Cigarettes also can be classified as "full flavor low tar" cigarettes. Typically, the "full flavor low tar" cigarettes deliver from about 8 to about 14 mg of FTC "tar" per cigarette, as well as lower levels of FTC nicotine as compared to "full flavor" cigarettes. Yet another classification of popular cigarettes is the "ultra low tar" cigarette which delivers still lower levels of FTC "tar" and nicotine. Typically, the "ultra low tar" cigarettes deliver less than about 7 mg of FTC "tar" per cigarette. The "full flavor low tar" and "ultra low tar" cigarettes conventionally have air dilution means such as laser perforations provided in the periphery of the mouth end region thereof, or have filter elements highly efficient for the removal of "tar" and nicotine from the mainstream aerosol. In general, the perceived taste or strength of the cigarettes classified as having lower levels of "tar" and nicotine are progressively less than that of the cigarettes which are classified as approaching the characteristics of the "full flavor" cigarettes. It has been proposed to add nicotine and other flavorants to the cut filler of lower "tar" cigarettes to enhance the taste, strength and satisfaction of such cigarettes. However, the addition of nicotine to such cigarettes generally yields mainstream smoke which may be perceived as harsh or irritating to the mouth, nose and throat of the user.

The addition of nicotine di-(p-toluoyltartrate) salts to cigarettes has been proposed in order to study the exogenous transfer of nicotine from the cigarette during smoking. See, for example, Houseman, *Beitr. Tabakforsch,* Vol. 7, p. 14 (1973); Jenkins et al, *Int'l Journal of Applied Radiation and Isotopes,* Vol. 27, p. 323 (1976); Armitage et al, *Quarterly Journal of Experimental Physiology,* Vol. 59, p. 55 (1974). However, the cited articles propose neither improved taste nor other enhanced smoking characteristics of the cigarettes as a result of the salt additive.

It would be desirable to provide a cigarette such as an "ultra low tar" cigarette which is capable of delivering a good tobacco taste, strength and smoking satisfaction characteristic of a "full flavor low tar" cigarette while not being perceived as being overly harsh or irritating. In addition, it would be desirable to provide a cigarette such as "full flavor low tar" cigarette which is capable of delivering a good tobacco taste, strength and smoking satisfaction characteristic of a "full flavor" cigarette while not being perceived as being overly harsh or irritating.

SUMMARY OF THE INVENTION

The present invention relates to a smoking article which delivers good tobacco taste while being capable of delivering relatively low amounts of FTC "tar." Preferred articles of this invention are cigarettes which deliver a taste, strength and smoking satisfaction characteristic of a "full flavor" cigarette, and relatively low levels of FTC "tar" characteristic of "full flavor low tar" cigarettes. Also preferred are cigarettes which deliver a taste, strength and smoking satisfaction characteristic of a "full flavor low tar" cigarette, and relatively low levels of FTC "tar" characteristic of "ultra low tar" cigarettes. In addition, the preferred cigarettes are extremely palatable and provide the perception of having a smooth smoking character (i.e., not providing a perceived harsh or irritating character) relative to a comparable cigarette delivering similar levels of FTC "tar." Of particular interest are cigarettes having (i) relatively low FTC "tar" to FTC nicotine ratios (ii) relatively low FTC carbon monoxide to FTC nicotine ratios, (iii) good tobacco flavor, strength and satisfaction, and (iv) a smooth, palatable smoking character without being overly mild tasting.

A smoking article in accord with this invention has incorporated therein at least one salt provided from nicotine and an organic acid. The salt is incorporated within the smoking article as an additive. Preferably, the salt is such that the molar ratio of nicotine to organic acid therein is 1:3. Most preferably, the salt additive includes nicotine levulinate. The particular salt is incorporated into the smoking article in such a manner that during use of the article, the salt is subjected to decomposition conditions. The presence of the salt within the article provides improved tobacco taste, strength and smoking satisfaction as well as improved or maintained flavor characteristics to the aerosol during use of the article. Preferred smoking articles do not exhibit undesirable off-tastes.

DETAILED DESCRIPTION OF THE PREFERRED EMBODIMENTS

Figure 1:
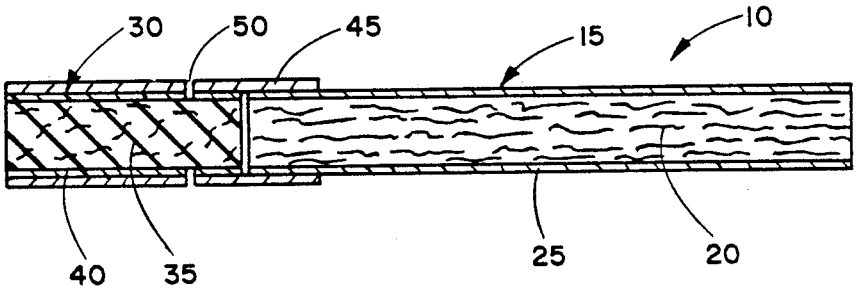
FIG. 1 is a longitudinal sectional view of a smoking article of this invention.

One embodiment of a smoking article of this invention is shown in FIG. 1 and has the form of a cigarette 10. The cigarette includes a generally cylindrical rod 15 of filler material 20 contained in circumscribing wrapping material 25. The rod 15 is hereinafter referred to as a "smokable rod" or a "tobacco rod." The ends of the tobacco rod are open to expose the filler material. The cigarette 10 also includes a filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough. The filter element 30 includes filter material 35 which is overwrapped along the longitudinally extending surface thereof with circumscribing plug wrap material 40.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the plug wrap 40 and the outer surface of the wrapping material 25 of the tobacco rod, using a suitable adhesive. If desired, a ventilated or air diluted smoking article is provided with an air dilution means such as a series of perforations 50 each of which extend through the tipping material and plug wrap.

Typically, the tobacco rod has a length which ranges from about 50 mm to about 85 mm, a circumference of about 17 mm to about 27 mm; and the wrapping material thereof is a conventional cigarette wrapping paper. If desired a dual wrapper system can be employed. The tobacco rods and the resulting cigarettes can be manufactured in any known configuration using known cigarette making techniques and equipment.

Typically, the filter element has a length which ranges from about 20 mm to about 35 mm and a circumference of about 19 mm to about 27 mm. The filter material can be any suitable material such as cellulose acetate, polypropylene, tobacco material, or the like. The plug wrap typically is a conventional paper plug wrap, and can be either air permeable or essentially air impermeable. However, if desired, a nonwrapped cellulose acetate filter element can be employed. The various filter elements suitable for use in this invention can be manufactured using known cigarette filter making techniques and equipment.

The filler material employed in the manufacture of the smokable rod can vary. Preferably, the majority of the filler material present in the smokable rod is a smokable material such as tobacco material, or a blend thereof with a tobacco substitute material. Examples of suitable tobacco materials include flue-cured, Burley, Md. or Oriental tobaccos; processed tobacco materials such as expanded tobaccos, processed tobacco stems, reconstituted tobacco materials or reconstituted tobacco materials having varying levels of endogenous and exogenous nicotine; or blends thereof. If desired, the tobacco materials can be blended with small amounts of carbonized and/or pyrolyzed materials. The smokable materials are employed in the form of particulates as is common in conventional cigarette manufacture. For example, the smokable filler material can be employed in the form of strands cut into widths ranging from about 1/25 inch to about 1/60 inch, preferably from about 1/30 inch to about 1/40 inch. Generally, such strands have lengths which range from about 0.25 inch to about 3 inches.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the smoking article can be varied in order to control the performance characteristics of the smoking article.

As used herein, the term "air dilution" is the ratio (generally expressed as a percentage) of the volume of air drawn through the air dilution means to the total volume of air and aerosol drawn through the smoking article and exiting the extreme mouth end portion of the smoking article. For air diluted or ventilated smoking articles of this invention, the amount of air dilution can vary. Preferably, the amount of air dilution for a cigarette is greater than about 20 percent, more preferably greater than about 30 percent. The upper limit of air dilution for a cigarette typically is less than about 80 percent, more frequently less than about 60 percent.

The salt provided from nicotine and an organic acid (also referred to herein as a "nicotine/organic acid salt") requires nicotine as a necessary component. The nicotine can be naturally occurring nicotine which is obtained as an extract from nicotineous species (e.g., tobacco) or synthetic nicotine. The nicotine can be l-nicotine, d-nicotine, or a mixture of d-nicotine and l-nicotine. Preferably, the nicotine is employed in relatively pure form (e.g., greater than about 95 percent pure, more preferably greater than about 99 percent pure) and is "water clear" in appearance in order to avoid or minimize the formation of tarry residues during the subsequent salt formation steps. The nicotine can be purified by distillation or other suitable methods.

Organic acids useful herein are any organic acids or organic compounds that behave as Lewis acids when contacted with nicotine. Preferred organic acids are those acids which form salts with nicotine in a 1:1, 2:1 or 3:1 molar ratio (organic acid:nicotine). Examples of organic acids useful in practicing the present invention are aromatic acids including benzoic-type acids and substituted benzoic-type acids, hydroxyacids, heterocyclic acids, terpenoid acids, sugar acids such as the pectic acids, amino acids, cycloaliphatic acids, dicarboxylic acids, aliphatic acids, keto acids, and the like. Preferred organic acids are the straight-chain and branched-chain aliphatic acids, more preferably the aliphatic monocarboxylic acids, and especially the keto aliphatic monocarboxylic acids. Examples of suitable organic acids include formic, acetic, propionic, isobutyric, butyric, alpha-methylbutyric, isovaleric, beta-methylvaleric, caproic, 2-furoic, phenylacetic, heptanoic, octanoic, nonanoic, malic, citric, oxalic, malonic, glycolic, succinic, ascorbic, tartaric, fumaric and pyruvic acids, as well as the lower fatty acids (i.e., having carbon chains less than $C_{12}$) and the higher fatty acids (i.e., having carbon chains of $C_{12}$ to $C_{20}$), and other such acids. The most preferred organic acid is a gamma keto aliphatic acid known as levulinic acid ($CH_3COCH_2CH_2COOH$). Useful organic compounds which exhibit an acid character and which form salts with nicotine include the phenolics such as guaiacol, vanillin, protocatechualdehyde, and the like.

Preferred nicotine/organic acid salts have a molar ratio of organic acid to nicotine of 1:1, 2:1 or 3:1, most preferably 3:1. The most preferred salts are totally ionized salts of nicotine and the organic acid. For example, a particularly preferred salt is provided from 1 mole of nicotine and 3 moles of levulinic acid and has a molar ratio thereof of 1:3.

The nicotine/organic acid salts are prepared using techniques generally known to those skilled in the art. Many of such techniques have been catalogued by Perfetti in *Beitraqe Zur Tbbakforschung International,* Vol.

12, No. 2, p. 43 (1983), which is incorporated herein by reference. Preferably, nicotine/organic acid salts are provided by contacting nicotine with at least the stoichiometric amount of the organic acid necessary to form the particular salt under conditions sufficient to form the salt.

The preferred salts provided from nicotine and the organic acid generally are essentially non-volatile at conditions under which the smoking articles are manufactured and stored, however, specific properties of the various salts can vary. For example, nicotine/organic acid salts having straight-chain or branched-chain aliphatic acids having less than 20 carbon atoms generally have a molar ratio of 1:3 (nicotine:acid), and generally are liquid in form at ambient conditions. Such salts typically decompose at temperatures less than 100° C., usually in the range from about 50° C. to about 60° C. As another example, nicotine/organic acid salts having dicarboxylic organic acids generally have a molar ratio of 1:2 (nicotine:acid), and generally are solid in form at ambient conditions. Such salts typically decompose at temperatures in the range from about 90° C. to about 120° C. As yet another example, nicotine/organic acid salts having acids containing phenyl groups generally have molar ratios of 1:1,.1:2 or 1:3 (nicotine:acid). Generally such salts are solid in form at ambient conditions. Such salts typically decompose at temperatures in the range from about 110° C. to about 200° C.

Numerous nicotine/organic acid salts can improve the flavor or aroma of the aerosol, as numerous organic acids are suitable flavorants. However, whether a particular nicotine/organic acid salt acts as a flavoaant depends upon the amount of the particular salt employed as an additive as well as the flavor threshold of the particular acid employed for the salt formation. See, for example, *Tobacco Flavoring For Smoking Products,* by Leffingwell et al, p. 11 to 15 (1972). Examples of salts which can provide flavor and aroma to the mainstream aerosol at certain levels include nicotine acetate, nicotine oxalate, nicotine mllate, nicotine isovalerate, nicotine lactate, nicotine citrate, nicotine phenylacetate and nicotine myristate. However, it may be desirable to use salts which provide flavor characteristics to the cigarette at low amounts in order to not provide undesirable off-tastes or aromas to the cigarette. For example, it may be desirable to employ certain salts at low enough levels in order that the cigarette does not exhibit taste or aroma characteristics which can be perceived as being chemical, metallic, bitter, pungent or soapy in nature, or as being dissonant to the general organoleptic characteristics associated with tobacco smoke.

The most preferred nicotine/organic acid salt is nicotine levulinate. Such a salt can provide a smooth, palatable character to the cigarette while not providing any significant dissonant taste or aroma. If desired, certain amounts of various nicotine/organic acid salts can be blended with nicotine levulinate and employed as the additive of this invention.

The salts can be incorporated into the smoking article in a variety of places or sites. For example, the salt can be applied to the filler material, incorporated within some or all of the filler material, applied to the wrapper of the tobacco rod, applied within the glue line of the wrapper of the tobacco rod, applied within a region (e.g., a cavity) which is subjected to heat, or the like.

Typically, the nicotine/organic acid salt additive or additive mixture is incorporated in the smoking article by admixing the additive with the smokable material. The manner or process for applying the additive can vary depending upon whether the additive is applied in solid or liquid form, or upon the positioning of the additive within the smoking article. For example, the additive can be applied using syringes or techniques such as spraying, electrostatic deposition, impregnation, garniture injection, spray drying, inclusion and encapsulation techniques, and the like.

When the nicotine/organic acid salts are applied using spraying techniques it is desirable to form a liquid solution of the salt in a suitable solvent. Such solutions should exhibit a low enough viscosity to allow for spraying or injecting the solution. However, it is desirable that the concentration of the salt within the solution not be so dilute that the salt experiences significant dissociation. Typically, the concentration of salt within the solution is about 20 weight percent or more.

Suitable solvents for the salts include water, ethanol, glycerol, propylene glyco,, and the like, as well as combinations thereof. Generally, most nicotine/organic acid salts are soluble or miscible in such solvents, and the salts do not undergo substantial dissociation when solubilized to small amounts. For example, the salt can be hydrated in water without undergoing a significant amount of dissociation. However, salts diluted with substantial amounts of solvent can undergo dissociation to some degree to provide for the application of a mixture of nicotine/organic acid salt, nicotine and organic acid to the smoking article. Thus, it is possible to apply an additive in the form of nicotine and levulinic acid to the smoking article.

If desired, smoking articles can have incorporated therein as an additive (i) at least one salt consisting of nicotine and an organic acid, and (ii) nicotine. Preferred additives of such type include at least one salt having a molar ratio of nicotine to organic acid of 1:3.

The amount of nicotine/organic acid salt or salts employed within the smoking article can vary. The amount of salt incorporated within the smoking article depends upon factors such as the placement of the salt within the smoking article, and the configurational aspects of the smoking article. Configurational aspects include the composition and characteristics of the filter material and initial filler blend, the degree of ventilation of the article, and other such factors. For example, for most cigarettes having filler material comprising a nicotine content of from about 1 weight percent to about 2 weight percent, it frequently is desirable to provide salt additive to provide a total nicotine content of up to about 8 weight percent, more frequently up to about 4 weight percent to the cigarette in order to provide tobacco taste, strength and satisfaction upon use. Generally, the amount of nicotine/organic acid salt applied to a cigarette provides from about 0.2 to about 15, preferably from about 1 to about 10 weight percent of salt additive, based on the total weight of the salt and the amount of filler material within the cigarette. In certain instances, it is desirable to employ about 3 weight percent of salt additive or more, based on the total weight of the salt and the amount of filler material within the cigarette.

The smoking articles of this invention preferably provide a mainstream aerosol exhibiting a pH which is essentially equal to or less than that of a similar smoking article not having the additive (e.g., the nicotine/organic acid salt additive) incorporated therein. In certain circumstances, an amount of nicotine/organic acid salt additive is incorporated into the smoking article in order to reduce the pH of the mainstream aerosol during use of the article. Mainstream aerosol is that aerosol which is drawn through the article and into the mouth of the user. For example, for a cigarette, the mainstream aerosol is the mainstream tobacco smoke which includes the combustion and/or pyrolysis products of tobacco material.

By the term, "pH of mainstream aerosol" is meant that averaged per-puff pH of the whole aerosol as measured using the techniques described by Sensabaugh et al in *Tobacco Science,* Vol. XI, pp. 25–30 (1967), which is incorporated herein by reference. Typical mainstream aerosol pH for cigarettes ranges from about 4.5 units to about 8.5 units on average per cigarette.

In referring to a reduction in the pH of mainstream aerosol, it is meant a lowering of the average pH of the mainstream aerosol per particular smoking article. Such reduction is provided by the addition of an effective amount of the additive (e.g., nicotine/organic acid salt additive). Typically, the reduction in pH is a lowering of the pH by more than about 0.03 pH unit; preferably by more than about 0.08 pH unit. Typically, reduction in the pH of the mainstream aerosol does not provide a smoking article exhibiting mainstream aerosol having a pH significantly below 4.5 units.

The decomposition of the nicotine/organic acid salt during use of the smoking article can introduce a reduction of the pH of the mainstream aerosol depending upon the quantity and type of salt additive which is incorporated into the smoking article. Thus, a certain balance, mellowing or marrying of the flavors culminate in a fuller bodied tobacco flavor, strength and satisfaction which is delivered to the user. Such a flavor enhancing characteristic is particularly desirable for highly air diluted or "ultra low tar" cigarettes.

The pH of the mainstream aerosol is influenced by a number of factors. For example, the pH of mainstream cigarette smoke can be influenced by factors such as the type of tobacco or blend of tobaccos employed, the type of processed tobacco (e.g., volume expanded tobacco or reconstituted tobacco), the configuration of the cigarette (e.g., the filter tow material, the degree of air dilution, the circumference of the cigarette, the type of wrapping material, etc.), the manner of drawing on or puffing the cigarette, and other such factors.

Cigarettes of this invention generally deliver from about 0.05 mg to about 2 mg, more frequently from about 0.1 mg to about 1.7 mg of nicotine when smoked under FTC conditions. Generally, FTC "tar" to FTC nicotine ratios for cigarettes of this invention are less than about 10, frequently less than about 7, and in certain instances less tan about 5. FTC "tar" to FTC nicotine ratios for cigarettes of this invention often can range from about 3 to about 6. Typically, the FTC "tar" to FTC nicotine ratio of a cigarette of this invention can be lowered by up to about 80 percent of that ratio of a similar cigarette not having the additive incorporated therein.

The following examples are provided in order to further illustrate the invention but should not be construed as limiting the scope thereof. Unless otherwise noted, all parts and percentages are by weight.

EXAMPLE 1

A salt of nicotine and levulinic acid is provided using the following procedure.

Into a 1,000 ml round bottom flask is charged about 350 g of 1-nicotine provided from Kodak Laboratory Chemicals, Eastman Kodak Co. (Catalogue oo. 52, p. 366, Chemical No. 1124973). To the 1-nicotine is charged about 10 g of sodium hydroxide pellets. The flask is fitted with a heating mantle and equipped with a magnetic stirring bar. The nicotine solution is stirred employing a magnetic stirring unit. The nicotine is vacuum distilled using a Todd Column packed with glass helixes, and the fraction distilled between 97° C. and 98° C. at 10 mm Hg pressure is collected at a reflux ratio of about 10:1. The collected distillate is water clear. The nicotine so purified using the vacuum distillation technique is employed in the preparation of the 1-nicotine/-levulinic acid salt.

Into a 500 ml round bottom flask equipped with a magnetic stirring bar and heating mantle is charged 9.6 g (0.6 mole) of levulinic acid. The levulinic acid is stripped employing a conventional magnetic stirring unit. The levulinic acid is obtained from Aldrich Chemical Co., Catalogue No. 1984–85, p. 672, Compound No. L-200-9, and is employed without further purification. The levulinic acid is heated to about 50° C. in order to provide a liquid form thereof, and the liquified component is subjected to stirring. To the liquified levulinic acid is titrated 32.4 g (0.2 mole) of the purified 1-nicotine over about a 20 minute time period. It is preferred to introduce the nicotine to the organic acid in order to provide an environment of excess acid to nicotine and thus promote the formation of salt. A clear, viscous yellow colored material weighing about 100 g results. The product is sealed in a glass ampuole under nitrogen.

The product is 1-nicotine levulinate (as determined using infrared spectrometry), and has a nicotine to levulinic acid ratio of 1:3 (as determined by a destructive distillation in a 10 percent sodium hydroxide aqueous solution, subsequent extraction using isopropanol, and gas chromatographic analysis for nicotine). The salt is believed to have a structure substantially as generally described in FIG. 13 of the Perfetti reference, supra.

EXAMPLE 2

Cigarettes incorporating varying amounts of the 1-nicotine levulinate salt are provided using the following procedure.

Cigarettes having lengths of about 99 mm and circumferences of about 24.85 mm have tobacco rod lengths of 68 mm and filter element lengths of 31 mm. The tobacco rod includes a charge of tobacco cut filler weighing about 0.7420 g contained in a circumscribing cigarette paper wrap which is sold commercially as 754 Cigarette Paper by Ecusta Corp. The filter element is manufactured using conventional cigarette filter making technology from cellulose acetate tow (2.7 denier per filament, 48,000 total denier) and circumscribing air permeable paper plug wrap having a CORESTA porosity of 26,000 cm/min. The tobacco rod and filter element are aligned in an abutting, end-to-end relationship and secured together using tipping paper having a CORESTA porosity of 3135 ml/min. The tipping paper is adhesively secured to the filter element and the adjacent portion of the tobacco rod. The tipping material circumscribes the length of the filter element and about 3 mm of the length of the tobacco rod. Cigarettes so described are manufactured using a Pilot Cigarette Maker from Hauni-Werke Korber & Co. KG. A ring of mechanically provided perforations extends around the periphery of the cigarette about 13 mm from the extreme mouth end thereof. The perforations so provided yield cigarettes which are 50 percent air diluted. The cigarettes so manufactured are designated Sample Nos. 1, 2, 3 and C-1, corresponding to the sample of filler material from which each cigarette is manufactured.

The filler material employed in providing the tobacco rod is in the form of strands cut at about 32 cuts per inch. The initial filler material includes a blend of about 9 percent Burley tobacco, about 41 percent flue-cured tobacco, about 32 percent reconstituted tobacco material, and about 18 percent Oriental tobacco. The blend has an aqueous casing of glycerin and flavors applied thereto.

Four lots of the cut filler blend, each lot weighing 1,520 g, are provided. The first lot is treated with 20 g of the 1-nicotine levulinate additive. The second lot is treated with 60 g of the 1-nicotine levulinate additive. The third lot is treated with 100 g of the 1-nicotine levulinate additive. The fourth lot is not treated with the 1-nicotine levulinate additive and is employed for comparison purposes.

The 1-nicotine levulinate additive is applied to cut filler as a spray using a hand sprayer to apply a 1:1 mixture of water and additive.

Each of the four lots are separately placed in sealed plastic bags and stored at 70° F. for 2 days. Then, the four lots are each mixed with about 480 g of a cut filler mixture of about 75 parts volume expanded Burley tobacco and about 25 parts volume expanded flue-cured tobacco. The volume expanded cut filler mixture is added to each lot using a mixing drum in order to provide a well mixed blend having a moisture content of about 12 percent to about 13 percent. The resulting blend provided from the first lot of filler material has about 1 percent of the 1-nicotine levulinate salt applied thereto and is designated as Sample No. 1. The resulting blend provided from the second lot of filler material has about 3 percent of the 1-nicotine levulinate salt applied thereto and is designated as Sample No. 2. The resulting blend provided from the third lot of filler material has about 5 percent of the 1-nicotine levulinate salt applied thereto and is designated as Sample No. 3. The resulting blend provided from the fourth lot of filler material is not treated with the 1-nicotine levulinate salt additive, is employed for comparison purposes, and is designated as Sample No. C-1.

The various cigarettes are smoked under FTC conditions. Data concerning (i) FTC "tar," FTC nicotine and FTC carbon monoxide, (ii) the "tar"/nicotine ratio, (iii) tobacco nicotine, (iv) puff count, and (v) pH of the mainstream aerosol for each sample are presented in Table I.

TABLE I

| Sample | FTC "tar" (mg/cigarette)[1] | FTC Nicotine (mg/cigarette)[1] | FTC CO (mg/cigarette)[1] | "Tar"/ Nicotine[2] | Total Nicotine(%)[3] | Puff Count[4] | Smoke pH[5] minimum | Smoke pH[5] maximum |
|---|---|---|---|---|---|---|---|---|
| 1 | 5.1 | 0.56 | 7.4 | 9.1 | 2.05 | 8.7 | 5.75 | 6.01 |
| 2 | 4.9 | 0.69 | 7.4 | 7.1 | 2.51 | 8.9 | 5.65 | 6.02 |
| 3 | 4.9 | 0.81 | 6.7 | 6.0 | 2.91 | 9.0 | 5.67 | 5.98 |
| C-1* | 4.6 | 0.38 | 7.5 | 12.1 | 1.66 | 8.8 | 5.85 | 6.10 |

*not an example of the invention.
[1]FTC conditions of two seconds of puffing (35 ml total volume) separated by 58 seconds of smolder.
[2]"Tar"/nicotine is the ratio of FTC "tar" to FTC nicotine delivered by the cigarette.
[3]Total nicotine is the total amount of nicotine (i.e., as nicotine present within the cigarette from all sources).
[4]Puff count is the average number of puffs per cigarette provided under FTC smoking conditons.
[5]Smoke pH is determined using the techniques described by Sensabaugh et al in Tobacco Science, Vol. XI, pp. 25-30 (1967). The presented mininum and maximum pH value for each cigarette are the calculated average of per-puff minimum and maximum values obtained for 8 puffs per cigarette.

The data in Table I indicate that the various cigarettes exhibit increased FTC nicotine values as the level of 1-nicotine levulinate is increased. In addition, the FTC "tar" to nicotine ratios for the samples decrease as the level of 1-nicotine levulinate is increased. The various cigarettes each exhibit similar "tar" deliveries, carbon monoxide deliveries and puff counts. Further, the samples of the invention (i.e., Sample Nos. 1-3) exhibit a pH of the whole smoke lower than that of the sample not having the exogenous nicotine/organic acid salt (i.e., Sample No. C-1).

Evaluations of the organoleptic properties of the Sample Nos. 2, 3 and C-1 indicate that the cigarette having 5 percent salt additive (i.e., Sample No. 3) exhibits greater impact and smoothness as well as less harshness than the cigarette not having salt additive (i.e., Sample No. C-1). Sample No. 2 is not significantly different organoleptically from Sample No. C-1 in terms of harshness and overall taste, even through there is a substantial increase in FTC nicotine of the sample relative to the comparative sample. Thus, the nicotine levulinate additive provides for a cigarette having a relatively low FTC "tar" to FTC nicotine ratio while having a smooth (i.e., not overly harsh) taste.

EXAMPLE 3

Cigarettes incorporating varying amounts of the 1-nicotine levulinate salt are provided using the following procedure.

Cigarettes having lengths of about 84 mm and circumferences of about 24.85 mm have tobacco rod lengths of 57 mm and filter element lengths of 27 mm. The tobacco rod includes a charge of tobacco cut filler weighing about 0.4875 g contained in a circumscribing cigarette paper wrap which is sold commercially as 854 Cigarette Paper by Ecusta Corp. The filter element is manufactured using conventional cigarette filter making technology from cellulose acetate tow (2.1 denier per filament, 48,000 total denier) and circumscribing non-air permeable paper plug wrap. The tobacco rod and filter element are aligned in an abutting, end-to-end relationship and secured together using a non-air permeable tipping paper. The tipping paper is adhesively secured to the filter element and the adjacent portion of the tobacco rod. The tipping material circumscribes the length of the filter element ad about 3 mm of the length of the tobacco rod. Cigarettes so described are manufactured using a Pilot Cigarette Maker from Hauni-Werke Korber & Co. KG. A ring of laser perforations are provided a mound the periphery of the cigarette about 13 mm from the extreme mouth end thereof. The perforations penetrate through the tipping paper and plug wrap, and are provided using a Laboratory Laser Perforator from Hauni-Werke Korber & Co. KG. The perforated cigarette is 75 percent air diluted. The cigarettes so manufactured are designated Sample Nos. 4, 5, 6 and C-2, corresponding to the sample of filler material from which each cigarette is manufactured.

The filler material employed in providing the tobacco rod is in the form of strands cut at about 32 cuts per inch. The initial filler material includes a blend of about 43 percent burley tobacco, about 6 percent flue-cured tobacco, about 19 percent reconstituted tobacco material, and about 32 percent Turkish tobacco. The blend has an aqueous casing of glycerin and flavors applied thereto.

Four lots of the cut filler blend, each lot weighing 940 g, are provided. The first lot is treated with 60 g of the 1-nicotine levulinate additive. The second lot is treated with 140 g of the 1-nicotine levulinate additive. The third lot is treated with 200 g of the 1-nicotine levulinate additive. The fourth lot is not treated with the 1-nicotine levulinate additive and is employed for comparison purposes.

The 1-nicotine levulinate additive is applied to cut filler as a spray using a hand sprayer to apply a 1:1 mixture of water and additive.

Each of the four lots are separately placed in sealed plastic bags and stored at 70° F. for 2 days. Then, the four lots are each mixed with about 1,060 g of a cut filler mixture of about 35 parts volume expanded burley tobacco and about 65 parts volume expanded flue-cured tobacco. The volume expanded cut filler mixture is added to each lot using a mixing drum in order to provide a well mixed blend having a moisture content of about 12 percent to about 13 percent. The resulting blend provided from the first lot of filler material has about 3 percent of the 1-nicotine levulinate salt applied thereto and is designated as Sample No. 4. The resulting blend provided from the second lot of filler material has about 7 percent of the 1-nicotine lvvulinate salt applied thereto and is designated as Sample No. 5. The resulting blend provided from the third lot of filler material has about 10 percent of the 1-nicotine levulinate salt applied thereto and is designated as Sample No. 6. The resulting blend provided from the fourth lot of filler material is not treated with the 1-nicotine levulinate salt additive, is employed for comparison purposes and is designated as Sample No. C-2.

For comparison purposes, Sample No. C-3 is prepared. Sample No. C-3 is provided by adding nicotine to a cigarette designated as Sample No. C-2. In particular, about 30 mg of a 1:1 mixture of ethanol and 85 percent pure 1-nicotine is injected into the cigarette in order to provide a nicotine content of about 3.92 percent to the cigarette. The nicotine/ethanol mixture is incorporated into the tobacco rod by inserting a syringe into the lighting end of the rod and slowly pulling the syringe from the rod while injecting the mixture into the rod.

Sample No. 7 is provided by injecting about 10 mg of the previously described 1:1 mixture of ethanol:nicotine into a cigarette designated as Sample No. 6 using a syringe in the manner previously described. The cigarette so provided comprises a nicotine levulinate additive as well as an exogenous nicotine additive.

The various cigarettes are smoked under FTC conditions. Data concerning (i) FTC "tar," FTC nicotine and FTC carbon monoxide, (i) the "tar"/nicotine ratio, (iii) tobacco nicotine, and (iv) puff count for Sample Nos. 4–6 and C-2 are presented in Table II. In addition, data concerning the pH of the mainstream aerosol for Sample Nos. 4–6, C-2 and C-3 are presented in Table II.

TABLE II

| Sample | FTC "tar" (mg/cigarette)[1] | FTC Nicotine (mg/cigarette)[1] | FTC CO (mg/cigarette)[1] | "Tar"/ Nicotine[2] | Total Nicotine (%)[3] | Puff Count[4] | Smoke pH[5] minimum | Smoke pH[5] maximum |
|---|---|---|---|---|---|---|---|---|
| 4 | 1.8 | 0.29 | 2.9 | 6.2 | 2.64 | 6.7 | 5.90 | 6.28 |
| 5 | 2.0 | 0.39 | 3.0 | 5.1 | 3.22 | 6.8 | 5.86 | 6.20 |
| 6 | 2.0 | 0.51 | 3.1 | 3.9 | 3.92 | 6.8 | 5.91 | 6.32 |
| C-2* | 1.8 | 0.18 | 2.9 | 10.0 | 2.08 | 6.7 | 6.13 | 6.42 |
| C-3* | — | — | — | — | — | — | 6.78 | 7.11 |

*not an example of the invention.

[1–4]See Table I, footnotes 1–4, respectively.

[5]Smoke pH is determined using the techniques described by Sensabaugh et al in Tobacco Science, Vol. XI, pp. 25–30 (1967). The presented minimum and maximum pH value for each cigarette are the calculated average of per-puff minimum and maximum values obtained for a number of puffs per cigarette. For Sample Nos. 4,5 and C-2, the number of puffs used to calculate the average pH values is 7. For Sample Nos. 6 and C-3, the number of puffs used to calculate the average pH values is 6.

The data in Table II indicate that the various cigarettes exhibit increased FTC nicotine values as the level of 1-nicotine levulinate is increased. In addition, the FTC "tar" to nicotine ratios for the samples decrease as the level of 1-nicotine levulinate is increased. The various cigarettes each exhibit similar "tar" deliveries, carbon monoxide deliveries and puff counts. Further, the samples of the invention (i.e., Sample Nos. 4–6) exhibit a pH of the whole smoke lower than that of the sample not having the exogenous addition, the pH of the whole smoke of Sample No. C-3 is very much higher than that of any of the other samples.

Evaluations of the organoleptic properties of Sample Nos. 5, 6 and C-2 indicate that the cigarette having 10 percent salt additive (i.e., Sample No. 6) exhibits greater impact and smoothness as well as less harshness than the cigarette not having the salt additive (i.e., Sample No. C-2). All cigarettes sampled provide good tobacco taste and do not exhibit a perceivable chemical off-taste or non-cigarette taste. Surprisingly, Sample No. 5 is not significantly different organoleptically from Sample No. C-2 in terms of impact, smoothness, harshness and overall taste even though the sample provides a higher level of FTC nicotine than the comparative sample. Sample No. C-3 is extremely harsh and is not palatable. However, Sample No. 7 surprisingly exhibits a smooth smoking character and is palatable, even though the sample has a relatively high level of exogenous nicotine incorporated therein.

What is claimed is:

1. A cigarette having incorporated therein as an additive at least one salt consisting of nicotine and an organic acid, wherein at least one of the salts has a molar ratio of nicotine to organic acid of 1:3, and at least one of the salts is a salt of nicotine and a gamma keto aliphatic monocarboxylic acid.

2. The cigarette of claim 1 wherein the ratio of FTC "tar" to FTC nicotine thereof ranges from about 3 to about 6.

3. A cigarette having nicotine levulinate incorporated therein as an additive.

4. The cigarette of claim 3 wherein the additive is a blend of nicotine levulinate and at least one other salt consisting of nicotine and an organic acid.

5. The cigarette of claim 1, 2, 3 or 4 wherein the pH of the mainstream aerosol thereof is essentially equal to or less than that of the cigarette not having the salt additive incorporated therein.

6. A cigarette having incorporated therein as an additive at least one salt consisting of nicotine and an organic acid such that the ratio of FTC "tar" to FTC nicotine of the cigarette is less than about 7.

7. The cigarette of claim 6 wherein the ratio of FTC "tar" to FTC nicotine ranges from about 3 to about 6.

8. The cigarette of claim 6 or 7 wherein the pH of the mainstream aerosol is essentially equal to or less than that of the cigarette not having the salt additive incorporated therein.

9. The cigarette of claim 6 wherein the organic acid is levulinic acid.

10. The cigarette of claim 6 wherein the additive is a blend of nicotine levulinate and at least one other salt consisting of nicotine and an organic acid.

11. The cigarette of claim 6 wherein the organic acid is an aliphatic monocarboxylic acid.

12. A cigarette having incorporated therein as an additive at least one salt consisting of nicotine and an aliphatic monocarboxylic acid in an amount sufficient to reduce the pH of the mainstream aerosol provided during use of the cigarette.

13. The cigarette of claim 12 wherein the aliphatic monocarboxylic acid is a gamma keto aliphatic monocarboxylic acid.

14. The cigarette of claim 13 wherein the acid is levulinic acid.

15. Tobacco cut filler including a nicotine levulinate additive.

16. The cigarette of claim 1, 2, 3, 4, 6, or 12 which is equipped with a means for providing air dilution thereto.

17. The cigarette of claim 1, 3 or 10 including smokable filler material wherein the salt additive is incorporated in an amount ranging from about 1 percent to about 10 percent, based on weight of the salt and the filler material of the cigarette.

18. A cigarette having incorporated therein as additives (i) at least on salt consisting of nicotine and an organic acid, at least one of the salts having a molar ratio of nicotine to organic acid of 1:3, and (ii) nicotine.

19. The cigarette of claim 18 wherein the organic acid is an aliphatic monocarboxylic acid.

20. The cigarette of claim 18 or 19 wherein the ratio of FTC "tar" to FTC nicotine is less than about 7.

21. The cigarette of claim 18 or 19 wherein the ratio of FTC "tar" to FTC nicotine ranges from about 3 to about 6.

22. The cigarette of claim 18 which is equipped with a means for providing air dilution thereto.

23. A cigarette including smokable filler material and having incorporated therein as additives (i) nicotine and (ii) levulinic acid, wherein the nicotine and levulinic acid additives are incorporated in the cigarette such that the molar ratio of nicotine additive to levulinic acid additive is about 1:3, and such that the amount of nicotine and levulinic acid additives incorporated in the cigarette is greater than or equal to about 3 percent, based on the weight of the nicotine additive, the levulinic acid additive and the filler material of the cigarette.

24. The cigarette of claim 23 wherein the ratio of FTC "tar" to FTC nicotine thereof is less than about 7.

25. The cigarette of claim 23 wherein the ratio of FTC "tar" to FTC nicotine ranges from about 3 to about 6.

26. The cigarette of claim 23 which is equipped with a means for providing air dilution thereto.

27. The cigarette of claim 23 further comprising as an additive a salt consisting of nicotine and an organic acid.

28. A smoking article having nicotine levulinate incorporated therein as an additive.

29. The smoking article of claim 28 further comprising nicotine as an additive.

30. A cigarette having incorporated therein as additives (i) at least one salt wherein one said is nicotine levulinate, and (ii) nicotine.

31. The cigarette of claim 30 wherein the ratio of FTC "tar" to FTC nicotine is less than about 7.

32. The cigarette of claim 30 wherein the ratio of FTC "tar" to FTC nicotine ranges from about 3 to about 6.

33. The cigarette of claim 30 which is equipped with a means for providing air dilution thereto.

34. Synthetically produced substantially pure nicotine levulinate.

35. The cigarette of claim 21 wherein the salt is nicotine levulinate.

36. The cigarette of claim 1, 3, 6, 9, 12 or 14 including smokable filler material wherein the cigarette has the additive incorporated therein as an additive to at least a portion of the filler material.

37. The cigarette of claim 18, 23, 24, 27, 30, 31 or 35 including smokable filler material wherein the cigarette has the additives incorporated therein as additives to at least a portion of the filler material.

38. The smoking article of claim 28 including smokable filler material wherein the smoking article has the additive incorporated therein as an additive to at least a portion of the filler material.

39. The cigarette of calm 1, 3, 6, 9, 12, 14, 18, 23, 24, 27, 31, 32 or 36 including smokable filler material wherein at least a portion of the smokable filler material is selected from burley tobacco, flue-cured tobacco, volume expanded tobacco and reconstituted tobacco.

40. The smoking article of claim 28 including smokable filler material wherein at least a portion of the smokable filler material is selected from burley tobacco, flue-cured tobacco, volume expanded tobacco and reconstituted tobacco.

41. The cigarette of claim 4, 18, 21 or 30 including smokable filler material wherein the salt additive is incorporated in an amount ranging from about 1 percent to about 10 percent, based on the weight of the salt additive and the filler material of the cigarette.

42. The tobacco cut filler of claim 15 wherein the amount of nicotine levulinate ranges from about 1 percent to about 10 percent, based on the weight of the nicotine levulinate and the filler.

43. The cigarette of claim 1, 3, 4, 10, 18, 21 or 30 including smokable filler material wherein the salt additive is incorporated in an amount of about 3 percent or more, based on the weight of the salt additive and the filler material of the cigarette.

44. The tobacco cut filler of claim 15 wherein the amount of nicotine levulinate is about 3 percent or more, based on the weight of the nicotine levulinate and the filler.

* * * * *

UNITED STATES PATENT AND TRADEMARK OFFICE

CERTIFICATE OF CORRECTION

PATENT NO. : 4,830,028

DATED : May 16, 1989

INVENTOR(S) : Lawson et al

It is certified that error appears in the above—identified patent and that said Letters Patent is hereby corrected as shown below:

Column 5, line 40, "mllate" should be --malate--.

Column 6, line 19, after "glyco" please delete ",".

Column 8, line 1, after "Catalogue" please delete "00." and insert therefor --No.--.

Column 8, line 15, after "charged" please delete "9.6" and insert therefor --69.6--.

Column 12, line 37, after "exogenous" please add --nicotine/organic acid salt (i.e., Sample No. C-2). In--.

Column 13, line 15, Claim 8, after "aerosol" please insert --thereof--.

Column 13, line 47, Claim 18, after "least" please delete "on" and insert therefor --one--.

Column 14, line 15, Claim 30, please delete "said" and insert therefor --salt--.

UNITED STATES PATENT AND TRADEMARK OFFICE

CERTIFICATE OF CORRECTION

PATENT NO. : 4,830,028

DATED : May 16, 1989

INVENTOR(S) : Lawson et al.

It is certified that error appears in the above-identified patent and that said Letters Patent is hereby corrected as shown below:

Column 14, line 40, Claim 39, please delete "calm" and insert therefor --claim--.

Signed and Sealed this

Twenty-fourth Day of July, 1990

*Attest:*

HARRY F. MANBECK, JR.

*Attesting Officer*

*Commissioner of Patents and Trademarks*